US005783376A

United States Patent [19]

Gordon et al.

[11] Patent Number: 5,783,376

[45] Date of Patent: *Jul. 21, 1998

[54] SULFO-SUBSTITUTED CARBOXYLATES AS BUFFERS FOR PHOTOGRAPHIC BLEACHES AND BLEACH-FIXES

[75] Inventors: Stuart Terrance Gordon, Pittsford; John Michael Buchanan; Sidney Joseph Bertucci, both of Rochester, all of N.Y.

[73] Assignee: Eastman Kodak Company, Rochester, N.Y.

[ * ] Notice: The term of this patent shall not extend beyond the expiration date of Pat. No. 5,460,924.

[21] Appl. No.: 856,365

[22] Filed: May 14, 1997

Related U.S. Application Data

[63] Continuation of Ser. No. 432,737, May 2, 1995, abandoned, which is a continuation-in-part of Ser. No. 230,261, Apr. 20, 1994, abandoned.

[51] Int. Cl.[6] ..... G03C 7/42

[52] U.S. Cl. ..... 430/460; 430/393; 430/430; 430/461

[58] Field of Search ..... 430/460, 461, 430/393, 430

[56] References Cited

U.S. PATENT DOCUMENTS

| | | | |
|---|---|---|---|
| 4,293,639 | 10/1981 | Itoh et al. | 430/461 |
| 4,301,236 | 11/1981 | Idota et al. | 430/393 |
| 4,328,306 | 5/1982 | Idota et al. | 430/393 |
| 4,992,346 | 2/1991 | Ashford | 430/2 |
| 5,006,456 | 4/1991 | Morigaki et al. | 430/461 |
| 5,061,608 | 10/1991 | Foster et al. | 430/461 |
| 5,316,898 | 5/1994 | Ueda et al. | 430/430 |
| 5,460,924 | 10/1995 | Buchanan et al. | 430/430 |
| 5,536,625 | 7/1996 | Buchanan et al. | 430/430 |

FOREIGN PATENT DOCUMENTS

93/11459 12/1991 WIPO .

OTHER PUBLICATIONS

Application Serial No. 07/990,500.
Application Serial No. 08/230,198.
Application Serial No. 8/407,343.

*Primary Examiner*—Hoa Van Le
*Attorney, Agent, or Firm*—Sarah Meeks Roberts; J. Lanny Tucker

[57] ABSTRACT

A composition for bleaching or bleach-fixing a silver halide photographic material has a pH of from 2 to 9. The composition comprises a bleaching agent which is either a persulfate or polyvalent metal complex of an aminopolycarboxylic acid, and from 0.01 to 2M of a sulfo-substituted carboxylate represented by Formula I $$(MO_3S)_n—R—(COOM)_m \quad (I)$$

wherein R is a benzene ring or a straight, branched or cyclic saturated aliphatic group having 2 to 8 carbon atoms;

M is hydrogen or an organic or inorganic cation; and n is 1 to 7;

with the proviso that if R is an aliphatic group, m is 2 to 4 and m and n combined cannot equal more than the number of carbon atoms in R plus two, and if R is a benzene ring, m is 2 to 5 and m and n combined cannot equal more than six.

19 Claims, No Drawings

SULFO-SUBSTITUTED CARBOXYLATES AS BUFFERS FOR PHOTOGRAPHIC BLEACHES AND BLEACH-FIXES

RELATED APPLICATION

This is a Continuation of U.S. Ser. No. 08/432,737, filed May 2, 1995, by Gordon, Buchanan and Bertucci, which in turn is a Continuation-In-Part application of U.S. Ser. No. 08/230,261 filed Apr. 20, 1994 by S. Gordon, J. Buchanan and S. Bertucci both now abandoned.

FIELD OF THE INVENTION

This invention relates to the processing of silver halide photographic materials and more specifically to photographic bleaching and bleach-fixing solutions.

BACKGROUND OF THE INVENTION

The robust photographic performance of bleaching and bleach-fixing solutions (and their replenishers) requires that their pH be maintained with buffering agents. Most commonly, organic carboxylic acids are used for this purpose, but examples of these compounds known in the art suffer from one or more important deficiencies. For example, low molecular weight aliphatic carboxylic acids, like acetic acid, are inexpensive, but they produce an objectionable odor. Low molecular weight aliphatic carboxylic acids are further unsuitable for use in persulfate bleaches because they are oxidized by the by-product of silver bleaching and decarboxylated to form alkyl radicals which attack imaging dyes.

Dibasic acids, such as succinic acid and adipic acid, have been suggested for use as bleach buffers in U.S. Pat. No. 5,061,608. They are also inexpensive and carry the additional benefit of buffering over a wider pH range than do monobasic acids. However, dibasic acids are unsuitable for use in persulfate bleaches because the oxidation and decarboxylation reactions mentioned above produce a monobasic acid whose odor can be extremely objectionable. Hydroxy-substituted carboxylic acids, such as glycolic acid, have a lower vapor pressure in aqueous solutions than does acetic acid, and thereby have fewer problems with objectionable odors; however, they are unstable in persulfate bleaches, particularly metal-catalyzed persulfate bleaches, due to rapid oxidation by persulfate. Other hydroxy-substituted carboxylic acids, such as citric acid, are such good chelating agents for ferric ion that, when used with aminopolycarboxylate bleaches, they displace the aminopolycarboxylate ligands whose chelation of iron is required for good bleaching and bleach-fixing.

Aromatic carboxylic acids, such as benzoic acid, and aromatic polycarboxylic acids such as phthalic acid and trimesic acid, have no odor problem, but their marginal water solubility precludes their use in solution concentrates. Aromatic sulfonic acids have been disclosed in U.S. Pat. No. 4,328,306 as additives for hydrogen peroxide bleaches, but these compounds are generally quite expensive and buffer poorly in the pH range 4 to 6 that is often desired for bleaching and bleach-fixing solutions.

Peroxide bleaching compositions are also described in copending and commonly assigned U.S. Ser. No. 08/230,365 filed Apr. 20, 1994 by Haye et al.

Therefore, a need exists for buffering agents which are versatile and which buffer over a broad pH range. Such buffers must also be highly water-soluble and inexpensive, and must have no objectionable odor.

SUMMARY OF THE INVENTION

A composition for bleaching or bleach-fixing a silver halide photographic material, the composition having a pH of from 2 to 9, and comprising a bleaching agent that is either a persulfate salt or a polyvalent metal complex of an aminopolycarboxylic acid, and from 0.01 to 2.0M of a sulfo-substituted carboxylate represented by Formula (I)

$$(MO_3S)_n—R—(COOM)_m \quad (I)$$

wherein R is a straight, branched, or cyclic saturated aliphatic group having 2 to 8 carbon atoms, or a benzene ring;

M is hydrogen or an organic or inorganic cation; and n is 1 to 7;

with the proviso that if R is an aliphatic group, m is 2 to 4 and m and n combined cannot equal more than the number of carbon atoms in R plus two, and if R is a benzene ring, m is 2 to 5 and m and n combined cannot equal more than six.

The sulfo-substituted carboxylates used in this invention are excellent buffers and can be used in a variety of bleaching and bleach-fixing solutions, including ferric chelate bleaches and bleach-fixers, peroxide bleaches, and persulfate bleaches. They buffer well in the pH range 3 to 7 and they are highly soluble over this entire pH range. Additionally, their use is associated with substantially no objectionable odor and their cost is generally not prohibitive. In persulfate bleaches the sulfo-substituted carboxylates do not interfere with the formation of dye density and their decomposition products also do not have an objectionable odor.

DETAILED DESCRIPTION OF THE INVENTION

The sulfo-substituted carboxylates of this invention are represented by Formula (I).

$$(MO_3S)_n—R—(COOM)_m \quad (I)$$

R is a straight, branched, or cyclic saturated aliphatic group having 2 to 8 carbon atoms, or it is a benzene ring. When the number of carbon atoms in R exceeds 8, the structures may behave as surfactants, causing foaming in the processing solutions in which they are employed. More preferably R has 2 to 4 carbon atoms, and most preferably R has 2 carbon atoms. R may have other substituents, although preferably it is unsubstituted except for the sulfo and carboxylate groups.

Possible other substituents of R include, for example, alkyl groups (for example, methyl, ethyl, hexyl), fluoroalkyl groups (for example, trifluoromethyl), alkoxy groups (for example, methoxy, ethoxy, octyloxy), halogen atoms, alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, carboxy groups, and cyano groups.

In Formula (I), when R is an aliphatic group, m is 2 to 4. More preferably m is 2 or 3. Most preferably, m is two. Structures in which m is at least two are preferred because they have more than one ionization in the pH range of 3 to 7. Such buffers buffer well over the entire 3 to 7 pH range. This is important because practical use often dictates significantly different pH values for solutions in the processing tank, the replenisher, the solution concentrate, and the regenerator.

When R is a benzene ring, m is 2 to 5 with the proviso that m plus n cannot be more than six. Preferably, m is 2 to 4, and more preferably, m is 2.

In Formula (I), n is 1 to 7. More preferably n is 1 to 4, and most preferably n is 1. The presence of one sulfonic acid substituent (in addition to the carboxylic acid groups) is generally sufficient to impact the desired high water solubility. For ease of synthesis, when R is an aliphatic group, m and n combined should not equal more than the number of carbon atoms in R plus two.

M is hydrogen or an organic or inorganic cation. Preferably M is hydrogen, a substituted or unsubstituted ammonium ion, or an alkali metal or earth metal cation, and most preferably M is hydrogen or a sodium or potassium ion.

Examples of compounds useful in this invention are:

sulfosuccinic acid and its salts
2-sulfobenzoic acid hydrate
3-sulfobenzoic acid sodium salt
4-sulfobenzoic acid potassium salt
4-sulfophthalic acid
4-sulfophthalic acid triammonium salt
4-sulfophthalic acid trisodium salt
5-sulfoisophthalic acid
3-sulfopropionic acid
2,3-disulfopropionic acid
3,4-disulfoadipic acid
3-sulfoglutaric acid
3-sulfotricarballylic acid (=-sulfo-1,2,3-propanetricarboxylic acid)

The most preferred compounds are the free acid and various salts of sulfosuccinic acid. Other preferred compounds are 4-sulfophthalic acid and 5-sulfoisophthalic acid or their salts.

The bleaching compositions of this invention may be bleaches or bleach fixes. The bleaching agents of this invention include compounds of polyvalent metal such as iron (III), cobalt (III), chromium (VI), and copper (II), persulfates, quinones, and nitro compounds. Typical bleaching agents are iron (III) salts, such as ferric chloride, ferricyanides, bichromates, and organic complexes of iron (III) and cobalt (III). Polyvalent metal complexes, such as ferric complexes, of aminopolycarboxylic acids and persulfate salts are most preferred bleaching agents of this invention, with ferric complexes of aminopolycarboxylic acids being preferred for bleach-fixing solutions. The buffers of this invention are particularly useful with persulfate bleaches. Examples of useful ferric complexes include complexes of:

nitrilotriacetic acid,
ethylenediaminetetraacetic acid,
1,3-propylenediamine tetraacetic acid,
diethylenetriamine pentaacetic acid,
ethylenediamine succinic acid,
ortho-diamine cyclohexane tetraacetic acid
ethylene glycol bis(aminoethyl ether)tetraacetic acid,
diaminopropanol tetraacetic acid,
N-(2-hydroxyethyl)ethylenediamine triacetic acid,
ethyliminodipropionic acid,
methyliminodiacetic acid,
ethyliminodiacetic acid,
cyclohexanediaminetetraacetic acid
glycol ether diamine tetraacetic acid.

Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.02 moles per liter of bleaching solution, with at least 0.05 moles per liter of bleaching solution being preferred. Examples of ferric chelate bleaches and bleach-fixes, are disclosed in DE 4,031,757 and U.S. Pat. Nos. 4,294,914; 5,250,401; 5,250,402; EP 567,126; 5,250,401; 5,250,402 and U.S. patent application Ser. No. 08/128,626 filed Sep. 28, 1993.

Typical persulfate bleaches are described in *Research Disclosure*, December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as *Research Disclosure*. Useful persulfate bleaches are also described in *Research Disclosure*, May, 1977, Item 15704; *Research Disclosure*, August, 1981, Item 20831; DE 3,919,551 and U.S. patent application Ser. No. 07/990,500 filed Dec. 14, 1992, now abandoned in favor of U.S. Ser. No. 101,136 (filed Aug. 2, 1993) which was also abandoned in favor of U.S. Ser. No. 230,189 (filed Apr. 20, 1994), which was divided, which two applications issued as U.S. Pat. Nos. 5,460,625 (Buchanan et al) and 5,536,625 (Buchanan et al). Sodium, potassium and ammonium persulfates are particularly preferred. For reasons of economy and stability, sodium persulfate is most commonly used.

In no instance do the compositions of this invention include peroxide bleaching agents. At the pH noted herein, persulfates are not known to decompose to provide peroxide. That phenomenon is known to occur only at a pH below 1.

The bleaching composition may be used at a pH of 2.0 to 9.0. The preferred pH of the bleach composition is between 3 and 7. If the bleach composition is a bleach the preferred pH is 3 to 6. If the bleach composition is a bleach-fix the preferred pH is 5 to 7. In one embodiment, the color developer and the first solution with bleaching activity may be separated by at least one processing bath or wash (intervening bath) capable of interrupting dye formation. This intervening bath may be an acidic stop bath, such as sulfuric or acetic acid; a bath that contains an oxidized developer scavenger, such as sulfite; or a simple water wash. Generally an acidic stop bath is used with persulfate bleaches.

The buffer compounds of this invention are used at concentrations and pH values such that the concentration of the basic form of the buffer is between 0.025 and 2.0M. For persulfate bleaches the concentration of the sulfo-substituted carboxylate is preferably 0.01M to 2.0M, with 0.05M to 1.0M being most preferred. When the bleaching agent is a polyvalent metal (e.g. ferric) complex of an aminopolycarboxylic acid, or if the bleaching composition is a bleach-fix, the concentration of the sulfo-substituted carboxylate is preferably 0.05M to 2.0M, with 0.1M to 1.5M being most preferred. The buffer may be added directly to the bleach composition as a solid or as an aqueous solution. Alternatively, in some cases it is possible to form these compounds in situ by mixing an unsaturated carboxylic acid with a bisulfite salt. For example, sulfosuccinic acid can be formed in situ by mixing maleic or fumaric acid (or a mixture thereof) with a sulfite or bisulfite salt.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, the bleaching solution may contain anti-calcium agents, such as 1-hydroxyethyl-1, 1-diphosphonic acid; chlorine scavengers such as those described in G. M. Einhaus and D. S. Miller, *Research Disclosure,* 1978, vol 175, p. 42, No. 17556; and corrosion inhibitors, such as nitrate ion, as needed.

The bleaching solutions may also contain other addenda known in the art to be useful in bleaching compositions, such as sequestering agents, sulfites, non-chelated salts of aminopolycarboxylic acids, bleaching accelerators, re-halogenating agents, halides, and brightening agents. In addition, water-soluble aliphatic carboxylic acids such as acetic acid, citric acid, propionic acid, hydroxyacetic acid, butyric acid, malonic acid, succinic acid and the like may be utilized in any effective amount. The bleaching compositions described here may be formulated as the working bleach solutions, solution concentrates, or dry powders. The bleach compositions of this invention can adequately bleach a wide variety of photographic elements in 30 to 240 seconds.

Examples of how the bleach compositions of this invention may be utilized are shown below:

(1)development→bleaching→fixing
(2)development→bleach fixing
(3)development→bleach fixing→fixing
(4)development→bleaching→bleach fixing
(5)development→bleaching→bleach fixing→fixing
(6)development→bleaching→washing→fixing
(7)development→washing or rinsing→bleaching→fixing
(8)development→washing or rinsing→bleach fixing
(9)development→fixing→bleach fixing
(10)development→stopping→bleaching→fixing
(11)development→stopping→bleach fixing The bleaches of this invention may be used with any compatible fixing solution. Examples of fixing agents which may be used in either the fix or the bleach fix are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used in the present invention.

The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing or bleach-fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The above mentioned bleach and fixing baths may have any desired tank configuration including multiple tanks, counter current and/or co-current flow tank configurations.

A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Additionally, reversal processes which have the additional steps of black and white development, chemical fogging bath, light re-exposure, and washing before the color development are contemplated. In reversal processing there is often a bath which precedes the bleach which may serve many functions, such as an accelerating bath, a clearing bath or a stabilizing bath. Conventional techniques for processing are illustrated by Research Disclosure, Paragraph XIX.

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. The element may also contain a magnetic backing such as described in No. 34390, *Research Disclosure*, November, 1992.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F, and G and the publications cited therein. These couplers can be incorporated in the elements and emulsions as described in Research Disclosure Section VII, paragraph C and the publications cited therein.

The photographic elements of this invention or individual layers thereof can contain among other things brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI) and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The color developing solutions typically contain a primary aromatic amino color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediamine monohydrochloride, 4-N,N-diethyl-2-methylphenylenediamine monohydrochloride, 4-(N-ethyl-N-2-methanesulfmethylphoethyl)-2-methylphenylenediamine sesquisulfate monohydrate, and 4-(N-ethyl-N-2-hydroxyethyl)-2-methylphenylenediamine sulfate.

In addition to the primary aromatic amino color developing agent, color developing solutions typically contain a variety of other agents such as bases to control pH, bromides, iodides, benzyl alcohol, anti-oxidants, antifoggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

The following examples are intended to illustrate, without limiting, this invention.

EXAMPLE 1

Preparation of Bleaching and Bleach-Fixing Solutions

Preparation of Persulfate Bleach A (Invention)

Two solutions are mixed separately, then combined to form eight liters of bleach. The first solution was prepared in a four liter beaker by mixing water (3.2 liters), sulfosuccinic acid (226.46 g of a 70% by weight aqueous solution), concentrated aqueous sodium hydroxide (sufficient to raise the pH to 4.0), sodium persulfate (238.10 g), and sodium chloride (116.88 g). The second solution was prepared in an eight liter titanium processing tank by mixing water (3.2 liters), 2,6-pyridinedicarboxylic acid (18.38 g), concentrated aqueous sodium hydroxide (sufficient to raise the pH to 4.0), ferric nitrate nonahydrate (20.20 g), and sodium carbonate (sufficient to raise the pH to 4.0). The first solution was added to the second, water was added to bring the volume to eight liters, and the pH was adjusted to 4.0 with sodium carbonate.

Preparation of Persulfate Bleach B (Invention)

Two solutions were mixed separately, then combined to form eight liters of bleach. The first solution was prepared in a four liter beaker by mixing water (3.2 liters), sulfosuccinic acid (2264.6 g of a 70% by weight aqueous solution), concentrated aqueous sodium hydroxide (sufficient to raise the pH to 5.0), sodium persulfate (238.10 g), and sodium chloride (116.88 g). The second solution was prepared in an eight liter titanium processing tank by mixing water (3.2 liters), 2,6-pyridinedicarboxylic acid (18.38 g), concentrated aqueous sodium hydroxide (sufficient to raise the pH to 4.0), ferric nitrate nonahydrate (20.20 g), and sodium carbonate (sufficient to raise the pH to 5.0). The first solution was added to the second, water was added to bring the volume to eight liters, and the pH was adjusted to 5.0 with sodium carbonate.

Preparation of Persulfate Bleach C (Comparison)

This bleach was prepared identically to Bleach B except that equimolar glacial acetic acid (480.4 g) was substituted for sulfosuccinic acid.

Attempted Preparation of Persulfate Bleach D (Comparison)

In a two liter beaker with magnetic stirring, distilled water (1 L) was combined with phthalic acid (16.61 g), beta-alanine (1.0 g), 2,6-pyridinedicarboxylic acid (4.41 g) and sufficient sodium hydroxide to raise the pH to 3.5. The solution was heated to 50° C. to facilitate dissolution of the phthalic acid and 2,6-pyridinedicarboxylic acid before the addition of ferric nitrate nonahydrate (4.85 g), sodium persulfate (60.0 g), sodium chloride (30.0 g), and sufficient sodium carbonate to adjust the solution pH to 3.5. On cooling to room temperature, this bleach produced a white precipitate. Note that no precipitate was formed in bleach A, above, which has a similar composition except for the identity of the buffer. This illustrates the poor solubility of phthalic acid under these relatively low pH, high ionic strength conditions.

Preparation of Persulfate Bleach E (Comparison)

In a 100 mL beaker with magnetic stirring, distilled water (50 mL) was combined with glacial acetic acid (6.0 g), 2,6-pyridinedicarboxylic acid (0.23 g), and sufficient ammonium hydroxide to raise the solution pH to 4.0. Ferric nitrate nonahydrate (0.25 g) was added, followed by sodium persulfate (5.95 g) and sodium chloride (0.88 g). The pH was adjusted to 4.0 with ammonium hydroxide, and the solution was diluted with water to a total volume of 100 mL. The solution had a pale, clear green color, characteristic of the ferric bis(2,6-pyridinedicarboxylate) complex.

Preparation of Persulfate Bleach F (Comparison)

The bleach was prepared identically to Bleach E, above, except that equimolar citric acid (9.21 g) was substituted for acetic acid. The bleach so prepared was yellow, with a small amount of white precipitate. The precipitate was filtered prior to the flow cell test described in Example 2.

Preparation of Persulfate Bleach G (Comparison)

The bleach was prepared identically to Bleach E, above, except that equimolar phosphoric acid (11.53 g of an 85% solution) was substituted for acetic acid, and the pH was adjusted to 3.0 instead of 4.0 (phosphoric acid, whose first pKa is 2.3, buffers marginally well at pH 3.0, but very poorly at pH 4.0). A large amount of white precipitate formed and was filtered off prior to the flow cell test described in Example 2.

Preparation of Persulfate Bleach H (Invention)

The bleach was prepared identically to Bleach E, above, except that equimolar sulfosuccinic acid (28.31 g of an 70% solution) was substituted for acetic acid. The solution had a pale, clear green color, characteristic of the ferric bis(2,6-pyridinedicarboxylate) complex.

Preparation of Persulfate Bleach I (Comparison)

The bleach was prepared identically to Bleach E, above, except that equimolar succinic acid (11.81 g) was substituted for acetic acid. The solution initially had a pale, clear green color, characteristic of the ferric bis(2,6-pyridinedicarboxylate) complex, but over the course of several minutes, it turned dark and deposited a large amount of white precipitate.

Preparation of Ferric PDTA Bleach J (Comparison)

To 0.5 liter of deionized water was added 1,3-propylenediaminetetraacetic acid (37.4 g) and glacial acetic acid (8.0 mL). Sufficient aqueous ammonium hydroxide was added to adjust the pH to 4.75, then ferric nitrate nonahydrate (44.85 g), 2-hydroxy-1,3-propylenediaminetetraacetic acid (0.5 g), and ammonium bromide(25.0 g) were added. The solution was diluted to 1.0 liter and its pH was adjusted to 4.75 with ammonium hydroxide.

Preparation of Persulfate Bleach K (Invention)

To an eight liter stainless steel tank were added six liters of distilled water, 4-sulfophthalic acid (748 mL of a 1.07M aqueous solution), 2,6-pyridinedicarboxylic acid (18.36 g), and sufficient concentrated aqueous sodium hydroxide to adjust the pH to 3.5. This was followed by the addition of ferric nitrate nonahydrate (20.23 g), sodium persulfate (238.10 g), sodium chloride (116.88 g), and sufficient distilled water to make eight liters. Aqueous sodium carbonate was used to adjust the final pH to 3.5.

Preparation of Persulfate Bleach L (Invention)

To a four liter stainless steel tank were added three liters of distilled water, 5-sulfoisophthalic acid monosodium salt (400 mL of a 1.00M aqueous solution), 2,6-pyridinedicarboxylic acid (9.19 g), and sufficient concentrated aqueous sodium hydroxide to adjust the pH to 3.5. This was followed by the addition of ferric nitrate nonahydrate (10.12 g), sodium persulfate (119.06 g), sodium chloride (58.44 g), and sufficient distilled water to make four liters. Aqueous sodium carbonate was used to adjust the final pH to 3.5.

Preparation of Bleach-Fixes M, N, O, and P

The compositions of these bleach-fix solutions are given in Example 5. All solutions are similar except for the identity of the buffer acid. To 500 mL water were added, with stirring, the thiosulfate and sulfite salts, followed by the buffer acid. A concentrated aqueous solution of the ferric EDTA complex (with 10% excess ligand) was then added, and the pH was adjusted to 6.2 with 7N sulfuric acid or 57% aqueous ammonium hydroxide. The total volume was adjusted to 1.0 liter.

Preparation of Bleaches O, R, S, T, U, and V

The compositions of these bleaching solutions are given in Examples 6 and 7. Solutions Q, R, and S are similar to each other, and solutions T, U, and V are similar to each other except for the identity of the buffer acid. To 500 mL water were added, with stirring, 1,3-propylenediaminetetraacetic acid, ammonium hydroxide, buffer acid, 2-hydroxy-1,3-propylenediaminetetraacetic acid, and ammonium bromide. Ferric nitrate was added as a concentrated aqueous solution, the pH was adjusted to 4.75 with 7N sulfuric acid or 57% aqueous ammonium hydroxide, and the volume was adjusted to 1 liter.

EXAMPLE 2

This example shows that citrate and phosphate buffers interfere with chelation of iron by 2,6-pyridinedicarboxylic acid, but that buffers of the invention do not. This experiment used a film-punch-holding flow cell and a UV-visible spectrophotometer to measure the rate of bleaching of a commercially available color negative film by small samples of various bleaches. Strips (35 mm×304.8 mm) of Kodacolor Gold 100 film were given a flash exposure on a 1B sensitometer (1/25 sec, 300K, Daylight Ca filter). The strips were developed and fixed (but not bleached) at 37.8° C. in standard color negative processing solutions (see British Journal of Photography, p. 196, 1988) as shown below:

| Time | Processing Solution |
|---|---|
| 3'15" | developer bath |
| 1' | stop bath |
| 1' | water wash |
| 4' | fixing bath |
| 3' | water wash |
| 1' | water rinse |

The film strips were air dried. To measure a bleaching rate, a 1.3 $cm^2$ round punch was removed from the strip and placed in a flow cell. This cell, 1 cm×1 cm×2 cm, was constructed to hold the film punch in a UV-visible diode array spectrophotometer, enabling the visible absorption of the punch to be measured while a processing solution is circulated past the face of the punch. Both the processing solution (20 mL) and the cell were maintained at 25° C. One hundred absorbance measurements (and average of the absorption's at 814, 816, 818, and 820 nm) were collected, typically, at five-second intervals over a 500-second span. The absorbance as a function of time was plotted, and the times required for 50% and 90% bleaching were determined graphically. Control experiments indicate that results from this flow cell method correlate well with bleaching rates in a standard sinkline process run at 37.8° C.

The data in Table 1, below, summarize bleaching rates for ferric-catalyzed persulfate bleaches prepared with a variety of buffers. It is evident that bleaching proceeds at adequate rates when the buffer is either acetate or sulfosuccinate, but bleaching is extremely slow when the buffer is either citrate or phosphate. It is demonstrated in the following example that acetate buffering is unacceptable for other reasons.

TABLE 1

Flow Cell Bleaching Rates As A Function Of Bleach Buffer

| bleach designation | buffer | time for 50% bleaching (sec) | time for 90% bleaching (sec) |
|---|---|---|---|
| E | acetate (comparison) | 71 | 151 |
| F | citrate (comparison) | 520 | 2310 |
| G | phosphate (comparison) | 410 | 1640 |
| H | sulfosuccinate (invention) | 68 | 159 |

EXAMPLE 3

Strips (35 mm×304.8 mm) of Kodacolor Gold Ultra 400 film were given a stepped exposure on a 1B sensitometer (1/100 sec, 300K, Daylight Ca filter, 21 step tablet, 0–4 density; step 1 corresponds to maximum exposure and maximum density). The following process using standard color negative processing solutions, except for the bleaches, was run at 37.8° C. (see British Journal of Photography, p. 196, 1988):

| Time | Processing Solution |
|---|---|
| 3'15" | Developer Bath |
| 1' | Stop Bath |
| 1' | Water Wash |
| 4' | Bleach B or C or J (with continuous air agitation) |
| 3' | Water Wash |
| 4' | Fixing Bath |
| 3' | Water Wash |
| 1' | Water Rinse |

The film strips were dried, and read densitometrically. (X-ray fluorescence spectroscopy confirmed that all processes provided excellent desilvering.) As shown in Table 2, below, the acetate-buffered persulfate bleach, C, caused huge losses in maximum dye densities, while the sulfosuccinate-buffered persulfate bleach, B, produced densities very similar to those of the conventional ferric chelate bleach, J.

TABLE 2

Flow Cell Bleaching Rates As A Function Of Bleach Buffer

| | maximum density (D-max) | | |
|---|---|---|---|
| bleach designation | red | green | blue |
| B (invention) | 2.09 | 2.55 | 3.09 |
| J (comparison) | 2.09 | 2.52 | 3.01 |
| C (comparison) | 1.49 | 1.39 | 2.47 |

EXAMPLE 4

Strips (35 mm×304.8 mm) of Kodacolor Gold Ultra 400 Film were given a flash exposure on a 1B sensitometer (½ sec, 3000K, Daylight Va filter, 21 step tablet, 0–6 density; step 1 corresponds to maximum exposure and maximum density). The following process using standard color negative processing solutions, except for the bleaches, was run at 37.8° C. (See British Journal of Photography, p 196, 1988):

| Time | Processing Solution |
|---|---|
| 3'15" | Developer Bath |
| 1' | Stop Bath |
| 1' | Water Wash |
| 0–2'* | Bleach K or L, (With Continuous Air Agitation) |
| 3' | Water Wash |
| 4' | Fixing Bath |
| 3' | Water Wash |
| 1' | Water Rinse |

(*bleach times were 0, 15, 30, 60, 120 seconds)

The film strips were dried, and residual silver was determined by x-ray fluorescence spectroscopy at steps 1, 2, and 3. The residual silver levels at these three steps were averaged to give the "Dmax silver" values in Table 3. It is evident that good bleaching was achieved with the aromatic carboxylic acid buffered bleaches of the invention.

TABLE 3

Effect Of Sulfo-Substituted Aromatic Buffers On Persulfate Bleaching Rates At pH 3.5

| BLEACH | Bleach Time (min) | Dmax silver (mg/sq m) |
|---|---|---|
| K (invention) | 0 | 14.083 |
| K | 15 | 7.328 |
| K | 30 | 3.712 |
| K | 60 | 1.414 |
| K | 120 | 0.612 |
| L (invention) | 0 | 14.981 |
| L | 15 | 6.942 |
| L | 30 | 3.396 |
| L | 60 | 1.181 |
| L | 120 | 0.642 |

EXAMPLE 5

A silver halide color paper (KODAK EKTAMAX RA Professional Paper), in the form of strips that were 305 mm long and 35 mm wide, was given a suitable exposure to light and then processed using a standard paper process, Process RA-4. All processing solutions were standard with the exception of the bleach-fix. The following bleach-fix formulations were used. The preparation of the bleach-fixes is described in Example 1.

| Chemical | Bleach-Fix M (Comparison) | Bleach-Fix N (Comparison) | Bleach-Fix O (Invention) | Bleach-Fix P (Comparison) |
|---|---|---|---|---|
| $(NH_4)_2S_2O_3$ | 0.533 M | 0.533 M | 0.533 M | 0.533 M |
| $(NH_4)_2SO_3$ | 0.048 M | 0.048 M | 0.048 M | 0.048 M |
| $Na_2SO_3$ | 0.079 M | .0.079 M | 0.079 M | 0.079 M |
| $Fe(NH_4)EDTA$ | 0.133 M | 0.133 M | 0.133 M | 0.133 M |
| Free EDTA | 0.013 M | 0.013 M | 0.013 M | 0.013 M |
| Acetic Acid | 0.175 M | | | |
| Succinic Acid | | 0.175 M | | |
| Sulfosuccinic Acid | | | 0.175 M | |
| Lactic Acid | | | | 0.175 M |
| pH | 6.2 | 6.2 | 6.2 | 6.2 |

Leuco Cyan Dye (LCD) was measured by reading the Status A Transmission Density of the D-Max step through the base of the paper. The data are presented in Table 4. It is apparent that Bleach-Fix O (invention) gives satisfactory performance while not suffering from the problems associated with other acids, such as solubility and odor problems.

TABLE 4

| Bleach-Fix | Red-D-Max Density - Green D-Max Density |
|---|---|
| M (Comparison) | +0.13 |
| N (Comparison) | +0.14 |
| O (Invention) | +0.13 |
| P (Comparison) | +0.14 |

EXAMPLE 6

A silver halide color negative film (KODAK EKTAR 125 Film), in the form of strips that were 305 mm long and 35 mm wide, was given a suitable exposure to light and then processed using a standard film process, Process C-41. All processing solutions were standard with the exception of the bleach. The following bleach formulations were used. The preparation of the bleaches is described in Example 1.

| Chemical | Bleach Q (Comparison) | Bleach R (Comparison) | Bleach S (Invention) |
|---|---|---|---|
| PDTA | 0.122 M | 0.122 M | 0.122 M |
| $NH_4OH$ (57%) | 0.87 M | 0.87 M | 0.87 M |
| Acetic Acid | 1.4 M | | |
| Succinic Acid | | 1.4 M | |
| Sulfosuccinic Acid | | | 1.4 M |
| Rexpronol Acid | 0.0025 M | 0.0025 M | 0.0025 M |
| $NH_4Br$ | 0.11 M | 0.11 M | 0.11 M |
| $Fe(NO_3)_3$ | 4.75 | 4.75 | 4.75 |

It was found that with the specific bleach and process utilized above the sulfosuccinic acid was not as effective of a buffer as the acetic acid and the succinic acid. This was unexpected given the pKa of the sulfosuccinic acid and may be due to the specific salt content of the bleach. The buffers of this invention have shown to be effective buffers with other iron chelate bleaches. There was also evidence of bleach induced dye formation which could be alleviated be adding a bath preceding the bleach bath.

EXAMPLE 7

A silver halide color paper (KODAK EKTACOLOR ULTRA Paper), in the form of strips that were 305 mm long and 35 mm wide, was given a suitable exposure to light and then processed using the separate bleach and fixer option for Process RA-4, a standard paper process. All processing solutions were standard with the exception of the bleach. The following bleach formulations were used. The preparation of the bleaches is described in Example 1.

| Chemical | Bleach T (Comparison) | Bleach U (Comparison) | Bleach V (Invention) |
|---|---|---|---|
| PDTA | 0.05 M | 0.05 M | 0.05 M |
| KOH (45%) | 0.25 M | 0.25 M | 0.25 M |
| $Fe(NO_3)_3$ | 0.045 M | 0.045 M | 0.045 M |
| Acetic Acid | 0.1 M | | |
| Succinic Acid | | 0.1 M | |
| Sulfosuccinic Acid | | | 0.1 M |
| Rexpronol Acid | 0.002 M | 0.002 M | 0.002 M |
| KBr | 0.2 M | 0.2 M | 0.2 M |
| pH | 4.75 | 4.75 | 4.75 |

The Status A Reflection density of the D-Min step was measured and is recorded in Table 6. It is apparent that Bleach V (invention) gives satisfactory performance while not suffering from the problems associated with other acids.

TABLE 6

| Bleach | Status A Blue D-Min Density |
|---|---|
| Bleach T (Comparison) | 0.09 |
| Bleach U (Comparison) | 0.09 |
| Bleach V (Comparison) | 0.09 |

Comparative Experiments

Attempts were made to prepare a ferric-catalyzed persulfate bleaching solution comprised of 6.25 mM ferric nitrate, 13.75 mM 2,6-pyridinedicarboxylic acid, 125 mM sodium persulfate, and 150 mM sodium chloride, and having a pH of 4, adjusted with ammonium hydroxide. This composition also contained 1M succinic acid as the buffer.

Initially, the solution was the expected green color and had good bleaching activity, but over the course of the next 27 days, the solution become yellow in color and a large amount of precipitate formed. A filtered portion of this sample was shown to have lost most of its bleaching activity (using procedures similar to those shown in Example 2 above). Thus, whereas the "fresh" solution provided 50% bleaching within 81 seconds, after the 27-day storage, the solution required 478 seconds to provide 50% bleaching. It was surprising that succinic acid was unacceptable as a buffer in a persulfate bleaching solution, and that precipitates formed and bleaching activity was significantly decreased upon storage.

When the identical procedure was attempted using fumaric acid as the buffer, it was impossible to dissolve all of the fumaric acid in solution. Moreover, when the buffer concentration was reduced by 90%, and used in the sodium salt form, it still would not dissolve adequately. This was unexpected since the art, particularly U.S. Pat. No. 5,316,898 (Ueda et al), would suggest that fumaric acid is a suitable buffer for bleaching solutions. Yet it was found that fumaric cannot be used because of its severely limited solubility.

Unsaturated buffers taught in the art, such as fumaric acid, maleic acid and others, cannot be used in the practice of this invention because they would readily polymerize in persulfate bleaching solutions since it is well known that persulfate is an initiator for free radical polymerization of vinyl compounds (see e.g., Kolthoff et al, J.A.C.S., 75, 1439–1441, 1953).

The sulfo-substituted compounds used as buffers in the practice of the present application are superior to unsubstituted dicarboxylic acids taught in Ueda et al, additionally, because they ionize at essentially all pH values used to bleach silver in photographic processing, and thus have improved solubility. This is not the case with unsubstituted dicarboxylic acids which are subject to decarboxylation by sulfate radical ion, a reaction which destroys the buffering benefits of a dicarboxylic acid and produces a monoacid of increased volatility and odor. The additional negative charge on the molecule from the sulfo group makes the compound less reactive than unsubstituted dicarboxylic acids toward sulfate radical ion. The pKa of the carboxylic acid on the molecule is also reduced by the presence of the sulfo group from an electron withdrawing effect, and thereby improves the buffering capacity in the pH range of 3–4 where most unsubstituted dicarboxylic acids buffer poorly.

The invention has been described in detail with particular reference to preferred embodiments thereof, but it will be understood that variations and modifications can be effected within the spirit and scope of the invention.

What is claimed is:

1. A composition for bleaching or bleach-fixing a silver halide photographic material, said composition having a pH of from 2 to 9, and consisting essentially of at least 0.02 mol/l of a bleaching agent that is either a persulfate salt or a polyvalent metal complex of an aminopolycarboxylic acid, and from 0.01 to 2.0M of a sulfo-substituted carboxylate represented by Formula (I)

$$(MO_3S)_n—R—(COOM)_m \quad (I)$$

wherein R is a benzene ring or a straight, branched or cyclic saturated aliphatic group having 2 to 8 carbon atoms, M is hydrogen or an organic or inorganic cation;

n is 1 to 7, with the proviso that if R is an aliphatic group, m is 2 to 4, and m and n combined cannot equal more than the number of carbon atoms in R plus two, and if R is a benzene ring, m is 2 to 5 and m and n combined cannot equal more than six, and further provided that said composition does not include a peroxide bleaching agent.

2. The composition of claim 1 wherein the concentration of the sulfo-substituted carboxylate is 0.05M to 2.0M.

3. A method of processing an imagewise exposed and developed silver halide photographic material wherein the silver halide photographic material is processed in an intervening bath capable of interrupting dye formation and is then processed in the composition of claim 1.

4. A composition for bleaching or bleach-fixing a silver halide photographic material, said composition having a pH of from 2 to 9, and consisting essentially of at least 0.02 mol/l of a persulfate bleaching agent, and from 0.01 to 2.0M of a sulfo-substituted carboxylate represented by Formula (I)

$$(MO_3S)_n—R—(COOM)_m \quad (I)$$

wherein R is a benzene ring or a straight, branched or cyclic saturated aliphatic group having 2 to 8 carbon atoms, M is hydrogen or an organic or inorganic cation;

n is 1 to 7, with the proviso that if R is an aliphatic group, m is 2 to 4, and m and n combined cannot equal more than the number of carbon atoms in R plus two, and if R is a benzene ring, m is 2 to 5 and m and n combined cannot equal more than six, and further provided that said composition does not include a peroxide bleaching agent.

5. The composition of claim 4 wherein R is an aliphatic group.

6. The composition of claim 5 wherein n is 1 to 4, m is 2 or 3, and M is hydrogen, an ammonium ion, or an alkali metal ion.

7. The composition of claim 6 wherein R has 2 to 4 carbon atoms.

8. The composition of claim 7 wherein m is 2 and n is 1.

9. The composition of claim 8 wherein the sulfo-substituted carboxylate is sulfosuccinic acid or its salts.

10. The composition of claim 4 wherein R is a benzene ring.

11. The composition of claim 10 wherein n is 1 to 4, m is 2 to 4, and M is hydrogen, an ammonium ion or an alkali metal ion.

12. The composition of claim 11 wherein m is 2, and n is 1.

13. The composition of claim 12 wherein the sulfo-substituted carboxylate is 4-sulfophthalic acid or 5-sulfoisophthalic acid or their salts.

14. The composition of claim 4 wherein the concentration of the sulfo-substituted carboxylate is 0.05M to 1.0M.

15. The composition of claim 4 wherein the bleaching composition has a pH of 3 to 7.

16. The composition of claim 4 wherein n is 1 to 4, R is an aliphatic group and has 2 to 4 carbon atoms, M is hydrogen, an ammonium ion or an alkali metal ion, and the bleaching composition has a pH of 3 to 7.

17. The composition of claim 4 wherein m is 2, and n is 1.

18. The composition of claim 4 wherein said sulfo-substituted carboxylate is sulfosuccinic acid, 4-sulfophthalic acid, 4-sulfoisophthalic acid, 3,4-disulfoadipic acid, 3-sulfoglutaric acid, 3-sulfotricarballylic acid, or a salt of any of these.

19. A method of processing an imagewise exposed and developed silver halide photographic material wherein the silver halide photographic material is processed in an intervening bath capable of interrupting dye formation and is then processed in the composition of claim 4.

* * * * *